United States Patent [19]

McLaren

[11] Patent Number: 4,895,203

[45] Date of Patent: Jan. 23, 1990

[54] HEAT EXCHANGER WITH HELICALLY COILED CONDUCT IN CASING

[75] Inventor: Keith S. McLaren, Queensland, Australia

[73] Assignee: Harold L. Hayes, Bulimba, Australia

[21] Appl. No.: 22,774

[22] Filed: Nov. 20, 1986

[30] Foreign Application Priority Data

Mar. 22, 1985 [AU] Australia ..... PG9873

[51] Int. Cl.[4] ..... B60H 1/08; F28D 7/12

[52] U.S. Cl. ..... 165/41; 165/51; 165/156; 165/160; 165/163; 165/905; 239/130

[58] Field of Search ..... 165/41, 51, 156, 160, 165/163, 184, 905; 123/557, 142.5; 239/129, 130

[56] References Cited

U.S. PATENT DOCUMENTS

| | | | |
|---|---|---|---|
| 1,132,757 | 3/1915 | Ashton | 165/163 |
| 1,740,300 | 12/1929 | Henszey | 165/156 |
| 1,791,531 | 2/1931 | Morrow | 165/163 |
| 2,471,317 | 5/1949 | Fausek et al. . | |
| 2,894,265 | 7/1959 | Reardon | 239/129 |
| 3,253,647 | 5/1966 | Deshaies | 165/163 |
| 3,756,510 | 9/1973 | Nitterl et al. | 239/130 |
| 3,802,499 | 4/1974 | Garcea | 165/160 |
| 4,232,735 | 11/1980 | Kim et al. | 165/184 |
| 4,306,614 | 12/1981 | Maggiorana | 165/51 |
| 4,354,548 | 10/1982 | Carlsson | 239/130 |
| 4,443,909 | 4/1984 | Cameron | 165/51 |
| 4,575,003 | 3/1986 | Linker et al. | 165/41 |
| 4,590,888 | 5/1986 | Mosig | 165/905 |

FOREIGN PATENT DOCUMENTS

| | | | |
|---|---|---|---|
| 1882462 | 9/1964 | Australia . | |
| 6833265 | 6/1967 | Australia . | |
| 1382966 | 5/1969 | Australia . | |
| 4109878 | 5/1980 | Australia . | |
| 2161583 | 10/1984 | Australia . | |
| 0108525 | 5/1984 | European Pat. Off. | 165/160 |
| 457679 | 6/1925 | Fed. Rep. of Germany | 165/156 |
| 2819777 | 11/1978 | Fed. Rep. of Germany | 165/160 |
| 1255437 | 1/1961 | France . | |
| 2155770 | 5/1973 | France . | |

*Primary Examiner*—John Ford

*Attorney, Agent, or Firm*—Lackenbach Siegel Marzullo & Aronson

[57] ABSTRACT

A compact highly efficient heat exchanger is used to utilize waste heat from a motor vehicle engine cooling system to heat a source of water for use with a shower or the like in a recreational environment. The heat exchanger comprises a hollow cylinder having a cylindrical wall to define an annular space therebetween. Within the annular space is located a neatly fitting helical tubular coil with spaced helixes to define a helical pathway between adjacent coil helixes working fluid passes through the tubular coil and process fluid passes through the helical pathway to effect heat exchange between the working and process fluids.

2 Claims, 2 Drawing Sheets

HEAT EXCHANGER WITH HELICALLY COILED CONDUCT IN CASING

Figure 1:
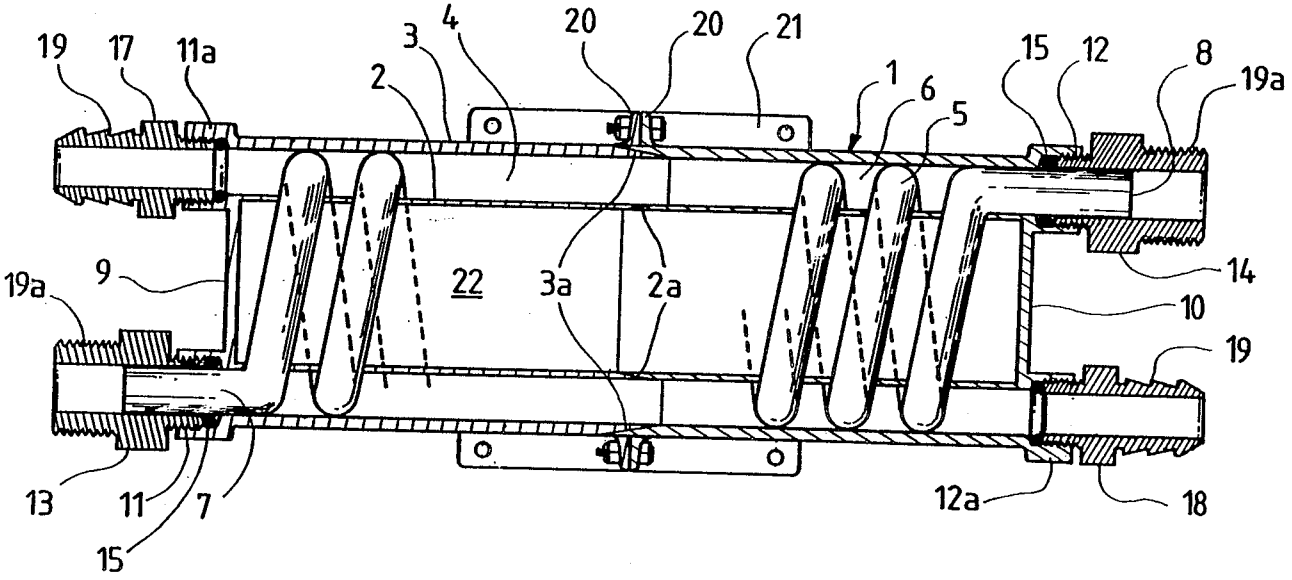

This invention is concerned with an improved heat exchanger for fluids and in particular to a compact unit designed to accommodate relatively low volumes of fluid at relatively low temperatures.

Most heat exchangers are designed on the basis of:

the temperature of the working fluid;

the desired temperature of the process fluid;

the relative volumes of the process and working fluids; and, a relative volumetric flow rates of the process and working fluids.

In the context of the present invention "working fluid" means that fluid which is utilized to heat or cool a "process fluid" in order that the "process fluid" may be used for a particular process. For example, in a motor vehicle engine cooling system, air passing through the radiator is the working fluid and the recirculating liquid coolant is the process fluid, used to cool the motor vehicle engine.

There are many parameters and variables to consider in the design of a heat exchange device and this results in widely differing shapes, sizes and constructional features if efficiency is to be optimized. Such heat exchange devices may vary from a simple conductive tubular metal coil located within a container of fluid (such as that described in my copending application No. 88767/82) to a highly complex plate or tube type heat exchanger of the type employed in many chemical industries.

It is an aim of the present invention to provide a compact but relatively efficient heat exchanger operable for relatively low temperatures and low pressure and flow rates.

According to the invention there is provided a heat exchanger comprising:

an elongate hollow jacket having an outer wall, an inner wall spaced from said outer wall and end walls defining an annular interior space therewithin;

a substantially helical tubular coil located within said annular interior space, said tubular coil having an axially outer surface adjacent an inner surface of said outer wall and an axially inner surface adjacent an outer surface of said inner wall to define a substantially helical pathway between adjacent helixes of said coil, inlet and outlet ports communicating with the interior of said tubular coil; and inlet and outlet ports communicating with said helical space.

The respective inlet and outlet ports may be located towards the opposed ends of the jacket and may be located in the jacket wall, but preferably in the opposed end walls of the jacket. Alternatively one or more ports may be located in the jacket wall and/or one or more may be located in the or each end wall of the jacket.

Most preferably the inlet and outlet ports are located in the opposed jacket end walls.

The hollow jacket may be of any suitable cross sectional shape but preferably it is circular thus defining a cylindrical jacket wall.

The hollow jacket may be formed from any suitable material by any suitable means and is preferably capable of withstanding heat and internal pressurization.

The jacket is suitably formed by a pressure moulding process such as die casting with zinc or a suitable metal alloy or by injection moulding with a plastics material such as polypropylene, nylon, polycarbonate, polyester or like polymeric materials, copolymeric plastics, the plastics material preferably including a fibrous reinforcing material such as glass fibres.

The jacket may be formed with a body portion and one or more separate end walls but most preferably is formed from a pair of substantially identical portions each having a cylindrical wall and an integrally formed end wall.

The helical tubular coil is suitably comprised of a heat conductive material such as copper or aluminium and it may have a smooth or finned inner and/or outer surface.

Figure 2:
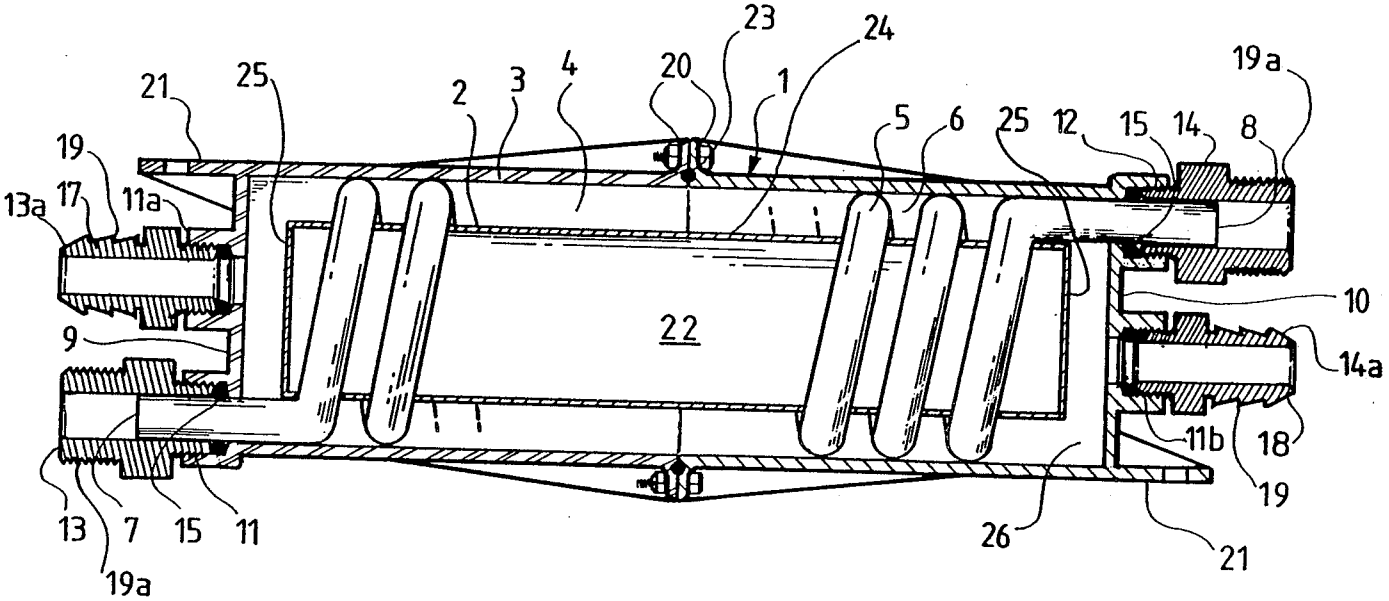

A preferred embodiment of the invention will now be described with reference to the accompanying drawings in which FIG. 1 illustrates one embodiment of the invention; and, FIG. 2 illustrates an alternative embodiment of the invention.

In FIG. 1 the device comprises an annular cylindrical jacket 1 having an inner wall 2 and an outer wall 3 defining therebetween an annular space 4. Located within annular space 4 is a helical coil 5 fabricated from copper tubing. The diameter of the copper tubing is chosen to be a neat fit within the annular space 4 to define a helical space or pathway 6 between adjacent helixes of the coil 5. Opposed ends 7,8 of the copper coil protrude through the end walls 9,10 of the jacket 1 and are sealed in fluid tight engagement therewith in any suitable manner.

A particular preferred manner of sealing is illustrated wherein the ends 7,8 of the coil protrude through screw threaded sockets 11,12 formed in the end walls 9,10 respectively. Screw threaded spigots 13,14 in sockets 11,12 to clamp therebetween an "o" ring 15 of rubber, plastics or the like to form a fluid tight seal between the outer wall of the tube and the socket and spigot assembly.

Similar spigot assemblies 17,18 are provided in sockets **11*a*,12*a* to communicate with the helical pathway 6. If required spigots 17,18 may be formed integrally with the end walls 9,10 and any one or all of the spigots 13,14 and 17,18 may include barbed flanges 19 as shown on spigots 17,18 to enable attachment of a flexible hose by means of a hose clamp or the like or they may include a threaded connection 19*a* as shown on spigots 13,14**.

The jacket 1 is preferably formed from injection moulded plastics and may be formed from two substantially identical mouldings connected at the mid point of the jacket by bolted or screwed flanges 20. Alternatively and/or in addition the walls 2 and 3 may be formed with complementary ramped surfaces **2*a*,3*a*** which may be glued or welded to ensure a fluid tight seal therebetween.

The jacket 1 may have formed integrally therewith a suitable mounting bracket 21 if required.

It will be seen that the present invention provides a simple and inexpensive form of heat exchanger which facilitates a particularly easy assembly. After formation of the coil on a suitable mandrel or the like the mating jacket halves are simply pushed together over the coil with the free ends of the coil protruding through the spigots 13,14. The flanges 19 and complementary ramped surfaces, **2*a*,3*a* are pre-glued and the assembly is firmly clamped together by bolts screws or rivets through the mating flanges 20**.

When assembled, inner walls 2 and end walls 9,10 define a hollow space 22 within the central region of the jacket 1.

FIG. 2 illustrates an alternative embodiment of the device shown in FIG. 1.

The jacket 1 comprises a hollow cylindrical body having an outer wall 3 and end walls 9,10. The jacket is comprised of a pair of substantially identical mouldings joined at flanges 20 by a plurality of nuts and bolts spaced around the flanges 20. A fluid tight seal is effected between the flanges 20 by a resilient rubber or plastics "o" ring 23 clamped therebetween.

Within jacket 1 is located a helically wound tubular highly thermally conductive copper coil 5 which is wound about a hollow highly thermally conductive copper tube 24 closed at both ends 25. In a similar fashion to the embodiment of FIG. 1 the copper coil 5 is a neat sliding fit between the inner surface of wall 3 and the outer surface 2 of tube 24 to define a helical pathway between adjacent helixes of coil 5.

The opposed free ends 7,8 of coil 5 are sealingly engaged in spigots 13,14 respectively located in screw threaded sockets 11,12 and fluid tight sealing is effected by a rubber or plastics "o" ring 15 clamped between the ends of the spigots, their respective sockets and a respective end of coil 5.

Additional spigots 17,18 located in respective screw threaded sockets 11*a*, 11*b* communicate with a plenum 26 at each end of the hollow interior of jacket 1 between end walls 9,10 and a respective adjacent closed end 25 of tube 24. Each plenum 26 communicates with the opposed ends of the helical pathway a formed between adjacent helixes of coil 5.

The spigots 13,13*a* and 14,14*a* may have threaded connections 19*a* as shown on spigots 13,14 or barbed hose connections 19 as shown on spigots 13*a*, 14*a*.

On the exterior of jacket 1, integrally formed mounting brackets 21 are provided for attachment of the heat exchanger to a suitable mounting surface. Preferably the heat exchanger is mountable within the engine compartment of a motor vehicle.

In use, the threaded spigots 13,14 are connected into the cooling fluid circuit of a motor vehicle. This connection may be effected by severing a hose in the vehicle heater circuit and connecting to the free ends of the hose mating threaded socket fittings for connection to the threaded spigots 19*a*.

Flexible hoses may then be connected to the barbed spigots 17,18. One of the flexible hoses is connected to a source of fluid e.g. water to be heated. The source may take the form of a container of water or the hose may be connected to a reticulated supply of water under pressure such as a faucet in a recreational vehicle park.

The other hose may be connected to a shower hose or other suitable fitting to control the flow of water.

The vehicle engine is started and the engine coolant is recirculated through coil 5. The source of water to be heated is allowed to pass through the helical passage 6, preferably in a countercurrent direction, whereupon the water is heated for use in a shower, for washing clothes, dishes, etc.

The temperature of the heated water may be regulated by adjusting the idling speed of the vehicle. engine and/or by adjusting the flow rate through passage 6. Flow rate may be conveniently controlled by a valve associated with the inlet or outlet hose.

The working fluid i.e. engine coolant, may be circulated via passage 6 but preferably is circulated via coil 5 as the working fluid pressures are likely to be considerably higher than the process fluid i.e. water being heated.

By means of this construction the copper coil is capable of utilizing a working fluid at relatively high temperatures and pressures in conjunction with a process fluid at relatively low temperatures and pressures.

The device according to the present invention is particularly suitable for utilizing waste motor vehicle engine heat by using the recirculating coolant as a working fluid at temperatures between say 40 degrees centigrade to 120 degrees centigrade and at pressures between 5 psi and 15 psi.

To demonstrate the efficacy of the heat exchange device according to the invention and the following tables show performance criteria using different motor vehicle engines operating different speed ranges and utilizing differing process fluid flow rates.

EXAMPLE 1

TABLE 1

| Engine RPM | Process Fluid Flow Rate Liter/min. | Process Fluid Inlet Temp. Deg. Centgrd. | Process Fluid Outlet Temp. Deg. Centgrd. | Temperature Rise Deg. Centgrd. |
|---|---|---|---|---|
| 500 | 3 | 28.5 | 53 | 24.5 |
| 500 | 6 | 28.5 | 42 | 17.5 |
| 1500 | 1.5 | 28.5 | 71 | 42.5 |
| 1500 | 3 | 28.5 | 63 | 34.5 |
| 1500 | 6 | 28.5 | 49 | 20.5 |

EXAMPLE 2

TABLE 2

| Engine RPM | Process Fluid Flow Rate Liter/min. | Process Fluid Inlet Temp. Deg. Centgrd. | Process Fluid Outlet Temp. Deg. Centgrd. | Temperature Rise Deg. Centgrd. |
|---|---|---|---|---|
| 750 | 1.5 | 28.5 | 70 | 41.5 |
| 750 | 3 | 28.5 | 58.5 | 30.0 |
| 750 | 6 | 28.5 | 48 | 19.5 |
| 1500 | 1.5 | 28.5 | 77 | 48.5 |
| 1500 | 3 | 28.5 | 66 | 37.5 |
| 1500 | 6 | 28.5 | 55 | 26.5 |

In both Examples 1 and 2 the same heat exchange device was employed.

The heat exchanger employed in the examples possessed the general configuration as illustrated in FIG. 2 having the following relevant dimensions:

Jacket:
- Internal length: 23.8 cm
- Internal diameter: 6.8 cm

Copper Coil:
- Length: 238 cm
- Diameter: $\frac{3}{8}$ inch (nominal O.D.)
- Wall Thickness: 18 gauge Internal Cylinder:
- Diameter: 4.8 cm
- Length: 20.5 cm Upon assembly all joints in the jacket including the threaded connections between the spigots and the body were coated with a curable epoxy resin composition to ensure a fluid tight connection.

The device may include a flow control means whereby the temperature of the process fluid is governed by its rate of flow through the heat exchange device. For greatest efficiency the working fluid flows countercurrent relative to the process fluid.

In a further embodiment of the invention the apparatus may have associated therewith an electric pump or the like to pump the process fluid therethrough. The pump may be separate or formed integrally with the device and may be attached at one end of the jacket or located within the central aperture 22 of the annular jacket in FIG. 1.

It will be readily apparent to a skilled addressee that many variations and modifications to the present invention will be possible without departing from the spirit and scope thereof.

I claim:

1. In a motor vehicle, the improvement comprising a heat exchanger for use with a motor vehicle engine to utilize waste heat from engine coolant, said heat exchanger comprising:

an elongate hollow jacket having an outer wall, an inner wall spaced from said outer wall and co-axial therewith about a longitudinal axis of said hollow jacket, and walls defining a closed annular space between said outer wall and said inner wall;

a helical tubular coil located closely between said outer wall and said inner wall within said annular space to define a helical fluid pathway between adjacent helixes of said coil;

inlet and outlet ports communicating with the interior of said tubular coil;

inlet and outlet ports communicating with said helical pathway;

said heat exchanger characterized in that said hollow jacket is comprised of substantially identical molded body halves joined by mating flanges intermediate opposed ends of said jacket, said body halves being composed of plastics material having low thermal conductivity, said tubular coil and said inner wall comprising a highly thermally conductive material mounted in an engine compartment of said motor vehicle, said inlet and outlet ports of said tubular coil being connected in fluid communication with a source of liquid coolant associated with said motor with a source of liquid coolant associated with said motor vehicle engine for circulation through said tubular coil, said inlet port communicating with said helical pathway being connectable to a source of liquid to be heated and said outlet port communicating with said helical pathway connected to a flexible hose to selectively draw heated liquid from said heat exchanger.

2. In a motor vehicle, the improvement comprising a heat exchanger for use with a motor vehicle engine to utilize waste heat from engine coolant, said heat exchanger comprising:

an elongate hollow jacket having an outer wall, an inner wall spaced from said outer wall and co-axial therewith about a longitudinal axis of said hollow jacket, and walls defining a closed annular space between said outer wall and said inner wall;

a helical tubular coil located closely between said outer wall and said inner wall within said annular space to define a helical fluid pathway between adjacent helixes of said coil;

inlet and outlet ports communicating with the interior of said tubular coil;

inlet and outlet ports communicating with said helical pathway;

said heat exchanger characterized in that said hollow jacket is comprised of substantially identical molded body halves joined by mating flanges intermediate opposed ends of said jacket, said body halves being composed of plastics material having low thermal conductivity, said tubular coil and said inner wall comprising a highly thermally conductive material mounted in an engine compartment of said motor vehicle, said inlet and outlet ports of said helical pathway being connected in fluid communication with a source of liquid coolant associated with said motor vehicle engine for circulation through said helical pathway, said inlet port communicating with said tubular coil being connectable to a source of liquid to be heated and said outlet port communicating with said tubular coil connected to a flexible hose to selectively draw heated liquid from said heat exchanger.

* * * * *